US011746404B2

(12) United States Patent
Ishii

(10) Patent No.: US 11,746,404 B2
(45) Date of Patent: Sep. 5, 2023

(54) BERYLLIUM COPPER ALLOY RING AND METHOD FOR PRODUCING SAME

(71) Applicant: NGK INSULATORS, LTD., Nagoya (JP)

(72) Inventor: Kensuke Ishii, Handa (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/203,965

(22) Filed: Mar. 17, 2021

(65) Prior Publication Data

US 2021/0301384 A1 Sep. 30, 2021

(30) Foreign Application Priority Data

Mar. 30, 2020 (JP) ..... 2020-060360

(51) Int. Cl.

| | |
|---|---|
| ***C22F 1/08*** | (2006.01) |
| ***B21K 1/76*** | (2006.01) |
| ***C22C 9/00*** | (2006.01) |

(52) U.S. Cl.

CPC ..... *C22F 1/08* (2013.01); *B21K 1/761* (2013.01); *C22C 9/00* (2013.01)

(58) Field of Classification Search

CPC .. C22F 1/08; B21K 1/761; C22C 9/00; C22C 1/02; B21J 5/002; B21J 5/10; C21D 9/40

See application file for complete search history.

(56) References Cited

U.S. PATENT DOCUMENTS 5,564,490 A 10/1996 Liebermann et al.
5,842,511 A * 12/1998 Raybould ..... B22D 11/0648 164/429

(Continued)

FOREIGN PATENT DOCUMENTS

JP H04-346639 A 12/1992
JP 3194268 B2 7/2001

(Continued)

OTHER PUBLICATIONS

Chinese Office Action (with English translation), Chinese Application No. 202110320735.2, dated Nov. 3, 2022 (16 pages).

(Continued)

*Primary Examiner* — John A Hevey
(74) *Attorney, Agent, or Firm* — BURR PATENT LAW, PLLC

(57) ABSTRACT

Provided is a method for producing a beryllium copper alloy ring including: providing a columnar forged material made of a beryllium copper alloy, opening a hole from a center of an upper surface of the columnar forged material in a direction parallel to a central axis of the columnar forged material to make a ring intermediate product, performing ring forging on the ring intermediate product, thereby expanding the hole such that a reduction ratio of 63% or more is achieved to make a ring-forged product, wherein the reduction ratio is specified by the following expression: $P=100\times(T-t)/T$, wherein P represents the reduction ratio (%), T represents a thickness (mm) of the ring intermediate product, and t represents a thickness (mm) of the ring-forged product, and performing a solution annealing and a precipitation hardening on the ring-forged product to make the beryllium copper alloy ring.

4 Claims, 3 Drawing Sheets

(56) References Cited

U.S. PATENT DOCUMENTS

| | | | | |
|---|---|---|---|---|
| 6,083,328 | A * | 7/2000 | Gravemann | C22C 9/06 148/435 |
| 2004/0112566 | A1 * | 6/2004 | Myojin | C22F 1/00 164/463 |
| 2010/0329923 | A1 | 12/2010 | Muramatsu | |

FOREIGN PATENT DOCUMENTS

| | | | |
|---|---|---|---|
| JP | 3977868 | B2 | 9/2007 |
| WO | 2009/119237 | A1 | 10/2009 |
| WO | 2012/096238 | A1 | 7/2012 |

OTHER PUBLICATIONS

Lewis, et al. "SA508 Gr. 4N Steel for New Generation Nuclear Pressure Vessels," 1st Edition, *Metallurgical Industry Press*, dated Nov. 2018 (3 pages).
Japanese Office Action (with English translation), Japanese Application No. 2020-060360, dated Oct. 12, 2022 (12 pages).
"Metalworking Practice, " 1st Edition, Huang Rulin et al., p. 58, Southeast Studies Press, Aug. 2016.
"Engineering Materials, " 1st Edition, Liu Hong et al., pp. 55-56, Beijing Institute of Technology Press, Apr. 2019.
Chinese Office Action (with English translation) dated Apr. 4, 2023 (Application No. 202110320735.2).
Japanese Office Action (with English translation) dated Apr. 5, 2023 (Application No. 2020-060360).

* cited by examiner

BERYLLIUM COPPER ALLOY RING AND METHOD FOR PRODUCING SAME

CROSS-REFERENCE TO RELATED APPLICATION

This application claims priority to Japanese Patent Application No. 2020-060360 filed Mar. 30, 2020, the entire content of which is incorporated herein by reference.

BACKGROUND OF THE INVENTION

1. Field of the Invention

The present invention relates to a beryllium copper alloy ring and a method for producing the same.

2. Description of the Related Art

Hitherto a ring for casting has been used in order to produce an alloy ribbon, such as an amorphous foil for a transformer. The ring for casting is obtained in such a way that an ingot obtained by melt-casting an alloy or the like is forged to obtain a forged material, and this forged material is then subjected to steps of hole opening, hole expansion (that is, ring forging), a solution annealing, and a precipitation hardening.

The alloy ribbon is obtained by dropping a molten alloy on the surface of the ring for casting while rotating the thus obtained ring for casting at a high speed, and peeling the molten alloy from the ring while quenching and solidifying the molten alloy. On this occasion, the surface of the ring is rapidly heated during being in contact with the molten alloy and is quenched after the molten alloy is peeled. That is, expansion and contraction of the ring for casting are repeated. Therefore, to endure severe temperature changes due to such a heat cycle, a ring for casting, for example, which has high hardness (strength) and an excellent thermal conductivity, which is hard to deteriorate at a high temperature, and which has a uniform micro-texture is needed. To micronize the crystal grains of a ring for casting, increasing the forging ratio of a forged material in a forging step has been performed as a conventional method. In addition, as a ring for casting which is excellent in thermal conductivity or the like, a ring for casting, for example, made of a beryllium copper alloy has been used.

For example, Patent Literature 1 (JP3977868B) discloses a quenching support which is for rapidly solidifying a molten alloy to make a ribbon, the quenching support having a microcrystalline texture or an amorphous texture, wherein a quenching surface is composed of a thermally conductive alloy, and the texture of the thermally conductive alloy is substantially homogeneous. As this quenching support, a beryllium copper alloy, which is a precipitation-hardening copper alloy, or the like is included.

In addition, Patent Literature 2 (JP3194268B) discloses a quench surface for rapidly solidifying a molten alloy into a ribbon having a microcrystalline structure or an amorphous structure. This quench surface is made of a thermally conductive alloy having a microstructure consisting of fine, equiaxed, recrystallized grains, the grains have an average size of 200 μm or less, the grains are not larger than 500 μm, and the grains have a tight gaussian grain size distribution. As a ring for casting having such a quench surface, a beryllium copper alloy or the like is used.

Further, Patent Literature 3 (WO2012/096238A1) discloses a method for continuously casting copper or a copper alloy, wherein a depth d (mm) of a surface defect of a copper or copper alloy rough drawing line produced by a belt & wheel method satisfies expression (I). Expression (I) indicates $d \leq r \times 0.1$, wherein d represents a depth of a surface defect of a rough drawing line, and r represents a radius (mm) of the rough drawing line. It is described that a beryllium copper alloy or the like is preferable as an alloy material composing a casting ring.

CITATION LIST

Patent Literature

[Patent Literature 1] JP3977868B
[Patent Literature 2] JP3194268B
[Patent Literature 3] WO2012/096238A1

SUMMARY OF THE INVENTION

However, when a conventional beryllium copper alloy ring as described above is used for producing an alloy ribbon, there is a problem in that cracks occur on the surface of the ring due to the repetition of heat expansion and heat contraction during casting the alloy ribbon. As a method for reducing the cracks, micronizing the crystal grains composing the beryllium copper alloy is known. For example, micronization of the crystal grains can be achieved by increasing the forging ratio in a forging step which is performed after casting and before opening a hole in the process of producing a beryllium copper alloy ring, and an effect of reducing the cracks to a certain extent is thereby obtained. However, there is a limitation in micronizing the crystal grains by increasing the forging ratio, and further improvements are desired. In addition, increasing the forging ratio leads to an increase in the production costs.

The present inventors have found that a beryllium copper alloy ring in which crystal grains are micronized can be produced by performing, on a forged material in which a hole is opened (namely, ring intermediate product), ring forging that expands the hole with a reduction ratio of a predetermined value or more.

Accordingly, an object of the present invention is to provide a beryllium copper alloy ring in which crystal grains are micronized, and a method for producing the beryllium copper alloy ring.

According to an aspect of the present invention, there is provided a method for producing a beryllium copper alloy ring comprising the steps of:

- providing a columnar forged material made of a beryllium copper alloy;
- opening a hole from a center of an upper surface of the columnar forged material in a direction parallel to a central axis of the columnar forged material to make a ring intermediate product;
- performing ring forging on the ring intermediate product, thereby expanding the hole such that a reduction ratio of 63% or more is achieved to make a ring-forged product, wherein the reduction ratio is specified by the following expression: $P=100\times(T-t)/T$, wherein P represents the reduction ratio (%), T represents a thickness (mm) of the ring intermediate product, and t represents a thickness (mm) of the ring-forged product; and
- performing a solution annealing and a precipitation hardening on the ring-forged product to make the beryllium copper alloy ring.

According to another aspect of the present invention, there is provided a beryllium copper alloy ring composed of a beryllium copper alloy, wherein the beryllium copper alloy has an average crystal grain size of 20 μm or less.

DETAILED DESCRIPTION OF THE INVENTION

Figure 1:
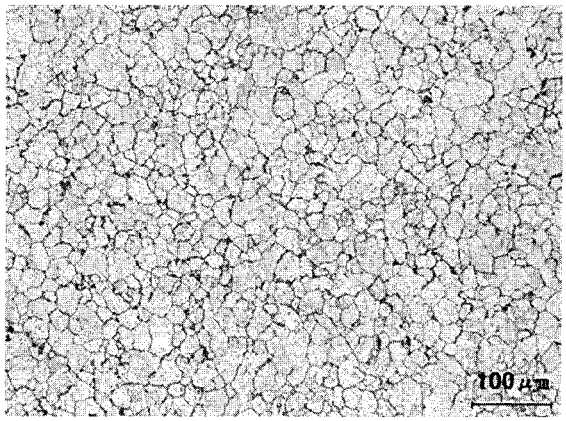
FIG. 1 is an optical micrograph of a cross section of a beryllium copper alloy ring prepared in Example 1 (Comparative Example).

The present invention relates to a beryllium copper alloy ring and a method for producing the same. The beryllium copper alloy ring which is produced by the method of the present invention is composed of a beryllium copper alloy, and crystal grains composing the beryllium copper alloy are micronized. As described above, cracks can occur on a conventional beryllium copper alloy ring accompanying casting of an alloy ribbon, but the cracks can significantly be reduced by micronizing the crystal grains composing the beryllium copper alloy more than those of the conventional beryllium copper alloy. The beryllium copper alloy preferably has an average crystal grain size of 20 μm or less, more preferably 17 μm or less, and still more preferably 15 μm or less. The beryllium copper alloy is more advantageous when the average crystal grain size is smaller from the viewpoint of reducing the cracks, and therefore the lower limit of the average crystal grain size is not particularly limited, and is typically 5 μm or more, more typically 7 μm or more, and still more typically 10 μm or more. It is to be noted that the average crystal grain size is determined by the procedure which will be described later in Examples. Producing such a beryllium copper alloy ring having a small average crystal grain size, namely a beryllium copper alloy ring in which the crystal grains are micronized, has been limited and difficult by a conventional method. However, according to the method for producing a beryllium copper alloy ring of the present invention, the beryllium copper alloy ring in which the crystal grains are micronized can be produced by performing ring forging with a high reduction ratio on a ring intermediate product.

The size of the beryllium copper alloy ring of the present invention is not particularly limited, and may appropriately be determined according to the intend use. In the case of the intended use for a ring for casting, the beryllium copper alloy ring of the present invention preferably has a size of an outer diameter of 320 to 2045 mm and an inner diameter of 265 to 1875 mm, more preferably an outer diameter of 620 to 2045 mm and an inner diameter of 460 to 1875 mm, and still more preferably an outer diameter of 830 to 2045 mm and an inner diameter of 680 to 1875 mm.

The composition of the beryllium copper alloy ring of the present invention is not particularly limited, and the beryllium copper alloy typically contains Be in an amount of preferably 0.2 to 2.0% by weight, more preferably 0.4 to 2.0% by weight, and still more preferably 1.8 to 1.9% by weight, and the balance consists of Cu and inevitable impurities. The beryllium copper alloy may further contain an optional element, such as Ni, Co, Fe, or Zr. Particularly when Zr is contained, the cracks can thereby be reduced. That is, the beryllium copper alloy preferably further comprises Zr.

The method for producing a beryllium copper alloy ring of the present invention includes (1) providing a columnar forged material made of a beryllium copper alloy, and sequentially performing (2) a hole-opening step, (3) a hole-expanding step, and (4) a solution annealing step and a precipitation hardening step.

(1) Providing Columnar Forged Material

A columnar forged material made of a beryllium copper alloy is first provided. The columnar forged material may be prepared by a known method and is not particularly limited, and is preferably obtained through a melt-casting step, a soaking treatment step, and an intermediate forging step.

In the melt-casting step, the beryllium copper alloy is melted and poured into a mold to cool and solidify the beryllium copper alloy, thereby obtaining an ingot. The melting temperature on this occasion is preferably 1100° C. to 1250° C.

In the soaking treatment step, the ingot is preferably retained at 800° C. to 850° C. for 6 hours or longer.

In the intermediate forging step, upsetting and cogging are repeated to the ingot to perform forging, thereby obtaining a columnar forged material having an easily processable size. The temperature on this occasion is preferably 530 to 760° C. The forging ratio is preferably 18 to 25. The size of the columnar forged material is preferably 450 to 850 mm in diameter×200 to 600 mm in height.

(2) Hole-Opening Step

A hole is opened from the center of the upper surface of the columnar forged material in a direction parallel to the central axis of the columnar forged material to make a ring intermediate product. The method for opening a hole may be performed by any method as long as a desired hole can be opened, but opening a hole is preferably performed by, for example, punching with a mold. The size of the ring intermediate product is not particularly limited and may appropriately be determined according to the intended use. In the case of the intended use for a ring for casting, the ring intermediate product preferably has a size of an outer diameter of 330 to 815 mm and an inner diameter of 150 to 250 mm, more preferably an outer diameter of 400 to 815 mm and an inner diameter of 150 to 250 mm, and still more preferably an outer diameter of 465 to 815 mm and an inner diameter of 160 to 250 mm.

In the hole-opening step, the columnar forged material is preferably heated. The temperature of the columnar forged material is preferably 550 to 800° C., more preferably 550 to 780° C., and still more preferably 550 to 750° C. Such heating makes it easy to open a hole in the columnar forged material.

(3) Hole-Expanding Step

The hole is expanded such that a reduction ratio of 63% or more is achieved by performing ring forging on the ring intermediate product to make a ring-forged product. The reduction ratio is specified by the following expression: $P=100\times(T-t)/T$, wherein P represents the reduction ratio (%), T represents the thickness (mm) of the ring intermediate product, and t represents the thickness (mm) of the ring-forged product.

The thickness T of the ring intermediate product here is specified by the following expression: $T=(D_O-D_I)/2$, wherein $D_O$ represents the outer diameter of the ring intermediate product, and $D_I$ represents the inner diameter of the ring intermediate product; and the thickness t of the ring-forged product is specified by the following expression: $t=(d_O-d_I)/2$, wherein $d_O$ represents the outer diameter of the ring-forged product, and $d_I$ represents the inner diameter of the ring-forged product. The reduction ratio is 63% or more, preferably 65% or more, more preferably 70% or more, and still more preferably 73% or more. The beryllium copper alloy ring in which the crystal grains are micronized can be produced by performing ring forging with a high reduction ratio on the ring intermediate product in this way. Therefore, the upper limit of the reduction ratio is not particularly limited, and is typically 90% or less, more typically 85% or less, and still more typically 80% or less.

As described above, micronization of the crystal grains can be achieved by increasing the forging ratio in the forging step which is performed after casting and before opening a hole in the process of producing a beryllium copper alloy ring, and the effect of reducing the cracks to a certain extent is thereby obtained. However, there has been a limitation in micronizing the crystal grains by increasing the forging ratio. In addition, increasing the forging ratio leads to an increase in production costs. These problems are solved favorably by performing ring forging with a high reduction ratio in the hole-expanding step.

The temperature at which ring forging is performed is preferably 530 to 780° C., more preferably 530 to 750° C., and still more preferably 530 to 720° C. The crystal grains composing the beryllium copper alloy ring can be micronized more effectively by lowering the working temperature in this way.

The size of the ring-forged product is not particularly limited, and may appropriately be determined according to the intended use. In the case of the intended use for a ring for casting, the ring-forged product preferably has a size of an outer diameter of 320 to 2045 mm and an inner diameter of 265 to 1875 mm, more preferably an outer diameter of 620 to 2045 mm and an inner diameter of 460 to 1875 mm, and still more preferably an outer diameter of 830 to 2045 mm and an inner diameter of 680 to 1875 mm.

(4) Solution Annealing Step and Precipitation Hardening Step

The solution annealing and the precipitation hardening are sequentially performed on the ring-forged product to make a beryllium copper alloy ring having desired characteristics. The beryllium copper alloy is an age-hardenable alloy and therefore can exhibit desired thermal refining characteristics (for example, high strength) through the solution annealing and the following precipitation hardening.

The solution annealing can be performed by heating the ring-forged product at a predetermined solution annealing temperature for a predetermined time and then performing a water quenching. A preferred solution annealing temperature is 700 to 950° C., more preferably 730 to 920° C., and still more preferably 760 to 900° C. The retention time at the solution annealing temperature is preferably 120 to 240 minutes, more preferably 120 to 180 minutes, and still more preferably 120 to 150 minutes.

The precipitation hardening can be performed by retaining the ring-forged product after the solution annealing at a predetermined precipitation hardening temperature for a predetermined time. A preferred precipitation hardening temperature is 280 to 450° C., more preferably 300 to 450° C., and still more preferably 320 to 450° C. The retention time at the precipitation hardening temperature is preferably 120 to 600 minutes, more preferably 180 to 300 minutes, and still more preferably 180 to 240 minutes.

Surface cutting may be performed on the ring-forged product and/or the beryllium copper alloy ring before and after the precipitation hardening. There are advantages that oxidized surfaces of the ring-forged product and/or the beryllium copper alloy ring can be removed, and the sizes of the ring-forged product and/or the beryllium copper alloy ring can be made into desired sizes by performing surface cutting.

EXAMPLES

The present invention will be described more specifically with reference to the following Examples.

Examples 1 to 7

Beryllium copper alloy rings were prepared and evaluated according to the following procedures.

(1) Casting

A beryllium copper alloy (Be content: 1.86 to 1.87% by weight, Co content: 0.24 to 0.25% by weight, Fe content: 0.02 to 0.03% by weight, the balance: Cu and inevitable impurities, UNS No.: C17200) was provided for Examples 1 to 5 and 7, and a beryllium copper alloy (Be content: 1.86 to 1.87% by weight, Co content: 0.24 to 0.25% by weight, Fe content: 0.02 to 0.03% by weight, Zr content: 0.2% by weight, the balance: Cu and inevitable impurities, UNS No.: C17200) was provided for Example 6. Each beryllium copper alloy was melted at a temperature of 1130 to 1170° C. to make a molten metal, and the molten metal was poured into a mold. The ingot which came out of the mold was cooled with water.

(2) Soaking Treatment

A soaking treatment was performed by retaining the obtained ingots at a temperature of 800 to 850° C. for 6 hours or longer.

(3) Intermediate Forging

Upsetting and cogging of each ingot after the soaking treatment were repeated at a temperature of 668 to 749° C. in such a way that the forging ratio was 18 to 25 to make a columnar forged material of 440 to 460 mm in diameter×110 to 460 mm in height.

(4) Hole Opening

A hole having a diameter of 160 to 250 mm was opened at a temperature of 550 to 748° C. from the center of the upper surface of the columnar forged material in a direction parallel to the central axis of the columnar forged material. On that occasion, the center of the upper surface of the columnar forged material was punched by pressurization with a press machine. Thereby, ring intermediate products each having a size shown in Table 1 were obtained.

(5) Hole Expansion Each hole was expanded by performing ring forging on each ring intermediate product at a temperature shown in Table 1 in such a way that the reduction ratio was as shown in Table 1. On that occasion, a core bar was inserted into the hole opened by pressing, and the hole was expanded while each ring intermediate product was being held and pressed from the outside and rotated. Thereby, ring-forged products each having a size shown in Table 1 were obtained.

(6) Solution Annealing and Precipitation Hardening

A solution annealing was performed on each ring-forged product by heating the ring-forged product at a temperature of 700 to 800° C. for 120 minutes and then cooling the ring-forged product with water, and further, surface cutting was performed. A precipitation hardening was performed on the ring-forged product, on which the solution annealing had been performed, by retaining the ring-forged product at a temperature of 300 to 350° C. for 120 to 180 minutes, and further, surface cutting was performed. Thus, beryllium copper alloy rings each having an outer diameter shown in Table 1 were obtained.

(7) Evaluation

The following evaluation was performed on the obtained beryllium copper alloy rings.

<Calculation of Average Crystal Grain Size>

Figure 2:
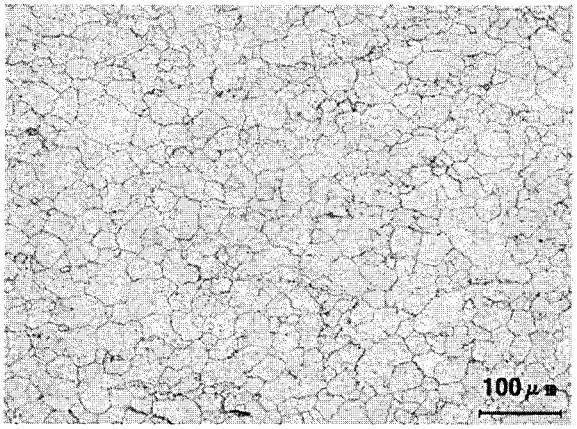
FIG. 2 is an optical micrograph of a cross section of a beryllium copper alloy ring prepared in Example 2 (Comparative Example).
Figure 3:
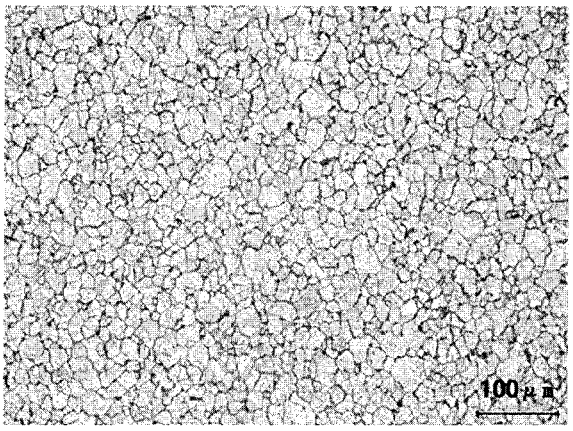
FIG. 3 is an optical micrograph of a cross section of a beryllium copper alloy ring prepared in Example 3.
Figure 4:
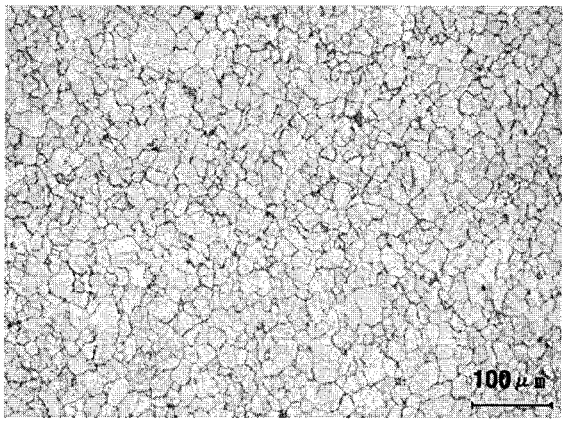
FIG. 4 is an optical micrograph of a cross section of a beryllium copper alloy ring prepared in Example 4.
Figure 5:
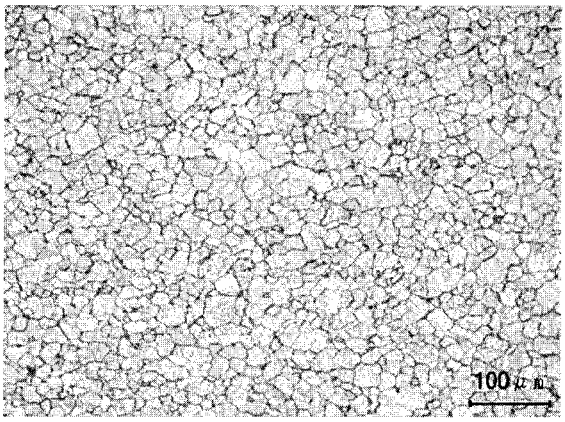
FIG. 5 is an optical micrograph of a cross section of a beryllium copper alloy ring prepared in Example 5.
Figure 6:
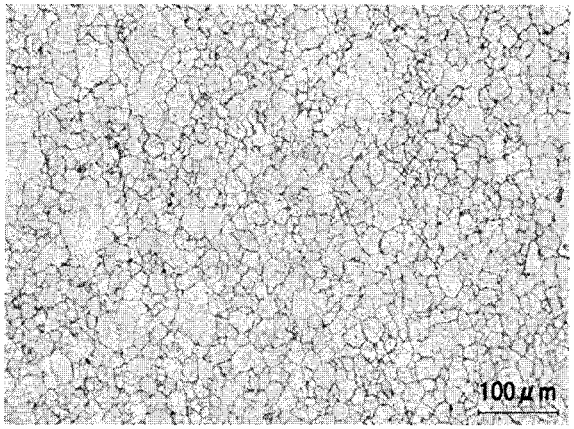
FIG. 6 is an optical micrograph of a cross section of a beryllium copper alloy ring prepared in Example 6.
Figure 7:
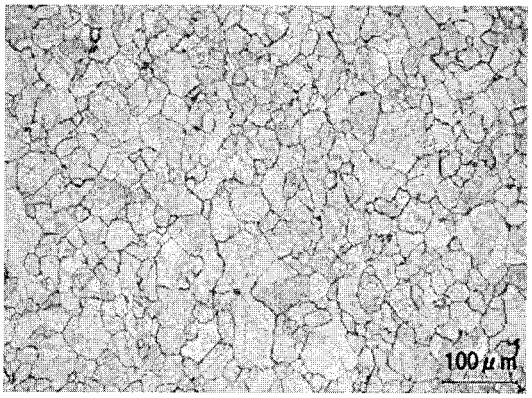
FIG. 7 is an optical micrograph of a cross section of a beryllium copper alloy ring prepared in Example 7 (Comparative Example).

The average crystal grain size of each beryllium copper alloy ring was calculated by a cutting method by observing a surface obtained by cutting the beryllium copper alloy ring in the thickness direction with an optical microscope and analyzing the micro-texture of the obtained cross section. Specifically, three lines were drawn on the photographed micro-texture image, and an arithmetic average value of values obtained by dividing the number of crystal grains which each line crosses by the length of the line was adopted as the average crystal grain size. The results are as shown in FIGS. 1 to 7 and Table 1. FIGS. 1, 2, 3, 4, 5, 6, and 7 correspond to Examples 1, 2, 3, 4, 5, 6, and 7, respectively.

TABLE 1

| | Hole-opening step | | | Hole-expanding step | | | | | | |
|---|---|---|---|---|---|---|---|---|---|---|
| | Size of ring intermediate product (after opening hole) (mm) | | | Ring-forging temperature (° C.) | Size of ring-forged product (after expanding hole) (mm) | | | Reduction ratio P (=100 × (T − t)/T) (%) | Beryllium copper alloy ring | |
| | Outer diameter $D_O$ | Innter diameter $D_I$ | Thickness T | | Outer diameter $d_O$ | Inner diameter $d_I$ | Thickness t | | Outer diameter (mm) | Average crystal grain size (μm) |
| Ex. 1* | 470 | 200 | 135 | 750 | 840 | 730 | 55 | 59 | 810 | 20.0 |
| Ex. 2* | 490 | 200 | 145 | 750 | 1070 | 945 | 62.5 | 57 | 1030 | 21.3 |
| Ex. 3 | 470 | 160 | 155 | 720 | 840 | 730 | 55 | 65 | 810 | 16.8 |
| Ex. 4 | 585 | 250 | 167.5 | 750 | 1240 | 1115 | 62.5 | 63 | 1200 | 18.8 |
| Ex. 5 | 815 | 250 | 282.5 | 750 | 2025 | 1870 | 77.5 | 73 | 1980 | 14.8 |
| Ex. 6 | 585 | 250 | 167.5 | 750 | 1240 | 1115 | 62.5 | 63 | 1200 | 19.1 |
| Ex. 7* | 470 | 250 | 110 | 750 | 840 | 730 | 55 | 50 | 825 | 27.7 |

*indicates Comparative Example $T = (D_O - D_I)/2$, $t = (d_O - d_I)/2$

From the results shown in Table 1, it is found that as the reduction ratio P is larger, the average crystal grain size of the beryllium copper alloy ring is smaller.

What is claimed is:

1. A method for producing a beryllium copper alloy ring comprising:

providing a columnar forged material made of a beryllium copper alloy;

opening a hole from a center of an upper surface of the columnar forged material in a direction parallel to a central axis of the columnar forged material to make a ring intermediate product;

performing ring forging on the ring intermediate product, thereby expanding the hole such that a reduction ratio of 63% or more is achieved to make a ring-forged product, wherein the reduction ratio is specified by the following expression: $P=100\times(T-t)/T$, wherein P represents the reduction ratio (%), T represents a thickness (mm) of the ring intermediate product, and t represents a thickness (mm) of the ring-forged product; and performing a solution annealing and a precipitation hardening on the ring-forged product to make the beryllium copper alloy ring;

wherein the ring forging is performed at a temperature of 530 to 780° C.;

wherein the beryllium copper alloy further comprises Zr; and wherein the beryllium copper alloy ring has an average crystal grain size of 19.1 μm or less.

2. The method for producing a beryllium copper alloy ring according to claim 1, wherein the ring forging is performed at a temperature of 530 to 720° C.

3. The method for producing a beryllium copper alloy ring according to claim 1, wherein the ring intermediate product has an outer diameter of 330 to 815 mm and an inner diameter of 150 to 250 mm.

4. The method for producing a beryllium copper alloy ring according to claim 1, wherein the ring-forged product has an outer diameter of 320 to 2045 mm and an inner diameter of 265 to 1875 mm.

* * * * *